US007195340B2

(12) United States Patent
Nagashima et al.

(10) Patent No.: US 7,195,340 B2
(45) Date of Patent: Mar. 27, 2007

(54) INK-JET RECORDING METHOD AND INK-JET INK

(75) Inventors: Akira Nagashima, Tokyo (JP); Shinichi Hakamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 320 days.

(21) Appl. No.: 11/019,533

(22) Filed: Dec. 23, 2004

(65) Prior Publication Data

US 2005/0195243 A1 Sep. 8, 2005

(30) Foreign Application Priority Data

Dec. 26, 2003 (JP) ..... 2003-434526

(51) Int. Cl.
*B41J 2/05* (2006.01)

(52) U.S. Cl. ..... 347/56; 347/100

(58) Field of Classification Search ..... 347/9, 347/17, 18, 20, 54, 56, 61, 62, 92–94, 100
See application file for complete search history.

(56) References Cited

U.S. PATENT DOCUMENTS 6,394,597 B1 5/2002 Koike et al. ..... 347/106
6,474,804 B2 11/2002 Osumi et al. ..... 347/100
6,599,356 B2 * 7/2003 Komatsu et al. ..... 347/100
6,758,542 B2 * 7/2004 Mizutani et al. ..... 347/5
2002/0041318 A1 4/2002 Osumi et al. ..... 347/100
2004/0252170 A1 * 12/2004 Watanabe et al. ..... 347/100

FOREIGN PATENT DOCUMENTS

JP 8034124 2/1996
JP 2001354880 12/2001
JP 2002080768 3/2002

* cited by examiner

*Primary Examiner*—Juanita D. Stephens
(74) *Attorney, Agent, or Firm*—Fitzpatrick, Cella, Harper & Scinto

(57) ABSTRACT

Disclosed herein is an ink-jet recording method comprising a step of applying thermal energy to an ink to generate bubbles thereby ejecting the ink from an ejecting portion to record, wherein the relationship among a cloud point (T) of a liquid obtained by removing coloring material from the ink, a temperature $T_0$ of the ink before formation of the bubbles in a portion in which the bubbles are generated and a temperature $T_1$ of a part of the ink, which includes a portion in contact with the bubbles and surrounds the bubbles, satisfies $T_0<T<T_1$.

8 Claims, 3 Drawing Sheets

INK-JET RECORDING METHOD AND INK-JET INK

BACKGROUND OF THE INVENTION

1. Field of the Invention

The present invention relates to an ink-jet recording method and an ink-jet ink, and particularly to an ink-jet recording method and an ink-jet ink, by which ejection responsiveness and ink droplet properties can be improved, and an ink tank and a cartridge equipped with a head, both containing this ink-jet ink.

2. Description of the Related Art

In ink-jet recording, various investigations have heretofore been made for the purpose of achieving good ejection of an ink. In particular, regarding methods for preventing defective ejection caused by bubbles remaining within a nozzle of a head or mixed therein, proposals have been made from many points of view, such as nozzle design and ink design. For example, Japanese Patent Application Laid-Open No. 2002-80768 discloses a method that an antifoaming agent such as siloxane is contained in ink compositions for a piezo-ejection system.

When such additives are contained in an ink mainly composed of water, additives having high stability at temperatures before and under an operating environment are selected. The additives include surfactants. Various functions of such a surfactant are utilized for ink-jet inks. Representatively, a nonionic surfactant is used as a component of an ink for the purpose of ensuring desired penetrability of the ink into recording media such as paper. In this case, it is said that its cloud point is preferably at least 60° C. in such a manner that the surfactant can exhibit the desired function in an operating environment of an ink-jet recording apparatus (Japanese Patent Application Laid-Open No. 2001-354880).

On the other hand, an ink-jet head by a system that thermal energy is utilized to cause film boiling, thereby applying an ink within a flow path from an ejecting portion to a recording medium is also put to practical use, and a great number of inventions are proposed and carried out.

In the ink-jet system that thermal energy is utilized to cause film boiling, thereby applying an ink within a flow path from an ejecting portion to a recording medium, a process of generation, growth and disappearance of bubbles attending on film boiling on a surface at which heat from a heating element (heater) acts on the ink is repeated in the flow path for every application of an ejection signal. The ink is applied to the recording medium in the form of droplets from the ejecting portion by receiving a pressure attending on the generation of bubbles. In the case of this system, when a part of the bubbles generated by the heat from the heater remains within the flow path, bubbles are naturally generated at a temperature under an operating environment of the apparatus, or bubbles are mixed into the flow path from a liquid chamber or the like, pressure transmission to the ink upon the generation of the bubbles on the surface of the heater is affected, which may form the cause of the deterioration of ink ejection properties such as deterioration of responsiveness to ejection signals, deformation of ink-droplet form, defective ejection of ink droplets and deterioration of ink droplet impact accuracy in some cases. Incidentally, with respect to the natural generation of bubbles at the temperature of the operating environment of the apparatus, minute bubbles are generated due to lowering of solubility of dissolved gasses in the ink when the temperature of the ink within the flow path is raised by increase of the number of times of ejection per unit time, and in some cases, these bubbles may become great bubbles which affect the ejection properties by their growth or bonding. Accordingly, it is important from the viewpoint of preventing the natural generation of bubbles to cause the bubble process to functionally progress to prevent unnecessary temperature rise of the ink within the flow path.

Methods for preventing the bubbles from remaining in or being mixed into the liquid chamber and flow path include a method that the antifoaming agent mentioned above is contained in the ink. The antifoaming agent has at least one of a function of inhibiting generation of bubbles and a function of making it easy to extinguish bubbles already generated. Various substances are investigated as foam inhibitors or antifoaming agents for ink-jet inks. The bubbles within the flow path can be extinguished to some extent by containing the foam inhibitor or antifoaming agent in the ink, however, the solubility of substances investigated as the foam inhibitors or antifoaming agents may be low in many cases. When such a substance is contained in the ink in an amount of producing the antifoaming effect, the foam inhibitor or antifoaming agent separates from the ink and adheres to members in contact with the ink and the periphery of an ejecting portion of the ink, which may become a new cause of defective ink ejection in some cases. In particular, in the Bubble-Jet system that thermal energy is utilized, a drive system is damaged by the adhesion of the foam inhibitor or antifoaming agent to the surface of the heater, so that defective ink droplet ejection may be caused in some cases.

On the other hand, the cloud points of additives contained in an ink are selected from the viewpoint of ensuring the solubility of the additives in the ink in the operating environment of a recording apparatus and preset to a temperature not lower than the temperature of the opening environment of the recording apparatus. In other words, the cloud points of the additives are not positively utilized for improving the ink ejection properties, and moreover no proposal for the cloud point properties of liquid media containing the additives is put.

SUMMARY OF THE INVENTION

It is accordingly a principal object of the present invention to provide an ink-jet ink that can control the state of bubbles generated within a flow path in an ink-jet head of the ink-jet system utilizing thermal energy and/or mixed into the flow path to improve the ink ejection properties of the head.

Another object of the present invention is to provide an ink-jet recording method using such an ink.

The present inventors have paid attention to accumulation of remaining bubbles in an ejecting portion, which is caused by bubbles generated for ejecting an ink for the purpose of improving the ejection stability of the ink in ink-jet recording that thermal energy is applied to an ink to generate bubbles, thereby ejecting the ink from an ejecting portion, and inhibition of generation of remaining bubbles and inhibition of accumulation of the remaining bubbles in the ejecting portion have been extensively investigated. As a result, attention has been paid to a gas-liquid interface between the bubbles generated in the ejecting portion and an ink in contact with the bubbles to find a phenomenon that remaining bubbles are inhibited, and accumulation of the remaining bubbles in the ejecting portion can also be inhibited by paying attention to the relationship among a cloud point (T) of a liquid obtained by removing coloring material from an ink obtained by containing the coloring material in a liquid medium having a cloud point, a temperature $T_0$ of the ink before formation of the bubbles in a portion in which the bubbles are generated and a temperature $T_1$ of a part of the ink, which includes a portion in contact with the bubbles and surrounds the bubbles in an ink-jet recording method that thermal energy is applied to the ink to generate the bubbles, thereby ejecting the ink from the ejecting portion to conduct recording. The present invention has been completed from this finding.

According to the present invention, there is thus provided an ink-jet recording method comprising a step of applying thermal energy to an ink to generate bubbles, thereby ejecting the ink from an ejecting portion to record, wherein the relationship among a cloud point (T) of a liquid obtained by removing coloring material from the ink, a temperature $T_0$ of the ink before formation of the bubbles in a portion in which the bubbles are generated and a temperature $T_1$ of a part of the ink, which includes a portion in contact with the bubbles and surrounds the bubbles, satisfies $T_0<T<T_1$.

According to the present invention, there is also provided an ink-jet recording method comprising a step of causing an ink to produce film boiling to eject ink droplets from an ejecting portion, thereby recording, wherein a cloud point (T) of a liquid obtained by removing coloring material from the ink falls within a range of from 50° C. to 60° C.

According to the present invention, there is further provided an ink-jet ink suitable for use in the above-described ink-jet recording method, which comprises water, an aqueous medium, a coloring material and a surfactant, wherein a cloud point of a liquid obtained by removing the coloring material from the ink falls within a range of from 50° C. to 60° C.

According to the present invention, there is still further provided an ink tank for containing an ink-jet ink, to which thermal energy for causing the ink to produce film boiling is applied, and which comprises water, an aqueous medium, a coloring material and a surfactant, wherein a cloud point (T) of a liquid obtained by removing the coloring material from the ink falls within a range of from 50° C. to 60° C.

According to the present invention, there is still further provided a cartridge comprising a container portion for containing an ink comprising water, an aqueous medium, a coloring material and a surfactant and an electrothermal conversion element for applying thermal energy to cause the ink to produce film boiling, wherein a cloud point (T) of a liquid obtained by removing coloring material from the ink falls within a range of from 50° C. to 60° C.

The present inventors expect the mechanism of this invention to develop antifoaming property by an action of lowering the interface-forming ability of the liquid which exhibits the cloud point when the liquid exhibiting the cloud point reaches a temperature exceeding the cloud point at the gas-liquid interface and thus expect the cloud point of the liquid obtained by removing coloring material from the ink to develop the effect that the above-described problem can be solved.

The ink used in the method according to the present invention is such that the cloud point of a liquid obtained by removing coloring material from the ink is a temperature higher than the lower limit of the temperature-changing range of the ink attending on the process of generation, growth and disappearance of bubbles by heating in a surface of a flow path, at which heat from a heater of an ink-jet head (hereinafter may also be referred as "head" merely) acts on the ink. The reason why good ink ejection properties are achieved when this ink is used is considered to be attributable to the fact that a part of the ink, with which the bubbles are in contact throughout the process of generation, growth and disappearance of the bubbles, particularly, an interface of the ink in contact with the bubbles is locally heated to a temperature higher than the cloud point while this process proceeds, and the properties of the liquid which exhibits the cloud point are changed in the vicinity of the interface to achieve effects such as formation of good ink droplets from the ejecting portion and inhibition of the generation of remaining bubbles. In other words, the present invention utilizes the property change by the condition that the cloud point of the liquid obtained by removing coloring material from the ink is preset to a temperature higher than the lower limit of the temperature-changing range of the ink within the flow path, thereby locally heating the ink interface in contact with the bubbles to a temperature higher than the cloud point, and is clearly different from the technique that the cloud point of an additive is preset to a temperature not lower than the temperature of the operating environment of the recording apparatus to ensure the solubility of the additive in the ink.

For example, the selection of a surfactant having a cloud point of at least 60° C. as a nonionic surfactant in Japanese Patent Application Laid-Open No. 2001-354880 intends to ensure the solubility of the nonionic surfactant in the ink under the operating environment of the recording apparatus, and this patent publication contains no technical idea as to how to preset the cloud point of the ink itself.

DESCRIPTION OF THE PREFERRED EMBODIMENTS

Figure 1:
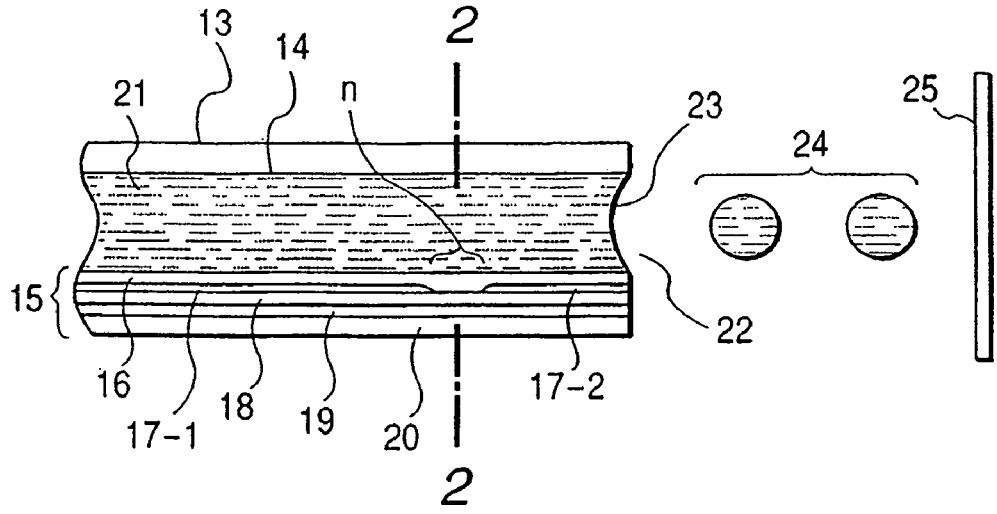
FIG. 1 is a longitudinal cross-sectional view of a head of an ink-jet recording apparatus.

The ink used in the present invention comprises an aqueous medium and a coloring material, and the cloud point of a liquid obtained by removing the coloring material from the ink is preset to a temperature higher than the lower limit of the local temperature-changing range of the ink in contact with bubbles in the bubble process of generation, growth and disappearance of the bubbles in ejection of ink droplets in a head. The cloud point of the liquid obtained by removing the coloring material from the ink can be preset on the basis of the above-described $T_0$ and $T_1$ obtained from:

(1) a temperature change of the ink within a flow path of the head, which is actually measured, (2) an estimate of the temperature change obtained by correcting the measured value of this temperature change according to the structure of the head, and (3) a value of the temperature change estimated from the structure of the head.

In the case of (2), for example, a method that the temperature of the ink at a specified position within a liquid chamber linking to the flow path is measured to estimate a temperature change upon bubbling from this found value is included.

These measurement methods are disclosed in Japanese Patent Application Laid-Open No. H08-034124 etc.

In an ink designed on the basis of the use form at room temperature, the ink within a flow path is held at a temperature of about 30 to 35° C. in the state that no ejection signal is applied. When an ejection signal is applied to a heater, a surface (heater surface), at which heat from the heater acts on the ink within the flow path, is momentarily raised to about 360 to 540° C. By this temperature rise of the heater surface, the ink in contact with the heater surface is heated to about 100° C. to cause film boiling and generate bubbles. A pressure attending on this momentary generation of the bubbles is applied to the ink as initial inertia force to acceleratorily cause the growth of the bubbles, and the ink is ejected as ink droplets from an ejecting portion linking to the flow path according to this growth. A temperature of a bubble-adjoining part (a part including a gas-liquid interface) of the ink, which surrounds the bubbles, is raised to about 70° C. upon the generation of the bubbles, and the temperature of the bubble-adjoining part of the ink is lowered to about 60 to 65° C. upon the growth of the bubbles, further lowered to 60° C. or lower upon disappearance of the bubbles and lowered again to about 30 to 35° C. by supplying the heater surface with the ink. When the cloud point of the ink is preset to a temperature higher than the lower limit of such a temperature-changing range of the ink, the functional progress of the bubble process and stable retention of bubble formation can be achieved to improve ink ejection properties.

Incidentally, the control of the progress of the bubble process and temperature change of the ink can be made by control on the side of a recording apparatus, such as control of a pulse width or pulse interval of an electric signal applied to the heater, or control of a scanning speed of a head to a recording medium. In the present invention, however, such control is made by changing the properties of the ink. By using the method according to the present invention, dependence on the control on the recording apparatus side can be reduced to simplify the construction of the apparatus and the construction of a control system on the apparatus side.

The cloud point of the liquid obtained by removing the coloring material from the ink may be preset to a temperature (for example, maximum temperature), to which the ink present in the bubble-adjoining part reaches throughout the bubble process, or lower according to the construction of the head, operating conditions of the apparatus according to a service environment, and/or the like. However, it is preferably preset within a range of from 50° C. to 60° C. when the use in a general-purpose recording apparatus is taken into consideration.

The ink in the present invention is designed in such a manner that the temperature of the part adjoining the bubbles generated on the heater surface becomes a temperature hither than the cloud point of the liquid obtained by removing the coloring material from the ink. Since this ink is held at a temperature lower than the cloud point at a part apart from the bubble, for example, in the vicinity of the ejecting portion, the influence of the presetting of the cloud point on the ejection properties of ink droplets and recording properties to recording media is substantially eliminated.

As the aqueous medium used in the ink according to the present invention, may be used water or a mixture of water and a water-soluble organic solvent. Specific examples of water-soluble organic solvents, which may be contained in the aqueous medium, include amides such as dimethylformamide and dimethylacetamide; ketones such as acetone; ethers such as tetrahydrofuran and dioxane; polyalkylene glycols such as polyethylene glycol and polypropylene glycol; alkylene glycols, the alkylene group of which has 2 to 6 carbon atoms, such as ethylene glycol, propylene glycol, butylene glycol, triethylene glycol, thiodiglycol, hexylene glycol and diethylene glycol; 1,2,6-hexanetriol; glycerol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; N-methyl-2-pyrrolidone, 1,3-dimethyl-2-imidazolidinone; triethanolamine; sulfolane; dimethyl sulfoxide; cyclic amide compounds such as 2-pyrrolidone and ϵ-caprolactam; and imide compounds such as succinimide. At least one of these compounds may be used.

As a method for presetting the cloud point of the liquid obtained by removing the coloring material from the ink to a prescribed value, may be used methods such as a method that a surfactant is added.

One surfactant suitably selected from publicly known surfactants or a combination of two or more thereof may be used by adjusting a relation with other components contained in the ink. The surfactant used in the ink is preferably composed of a nonionic surfactant from the viewpoint of stability of the ink, in addition to easy control of the cloud point.

The content of the surfactant in the ink is preset in such a manner that the resulting ink has a desired cloud point and is selected according to the kinds of other components of the ink and their amounts contained. As examples of the coloring material of the ink, may be mentioned dyes and pigments for ink-jet inks. Its concentration in the ink is suitably preset according to desired use of the ink.

Besides the above components, for examples, additives such as urea, thiourea, urea derivatives, surfactants utilizing other functions than the control of the cloud point, pH adjustors, viscosity modifiers, preservatives, antioxidants, evaporation accelerators evaporation inhibitors, rust preventives, mildewproofing agents and chelating agents may be incorporated in the ink.

A cloud point of a liquid obtained by removing coloring material from an ink containing the coloring material to such a level that the cloud point can be identified using a means such as a centrifugal separator or filtration is measured, whereby the same effects can also be achieved in the ink-jet recording method by which the relationship of the present invention is established.

The content of water in the aqueous medium of the ink as used for the present invention falls within the range of 50 to 100% by weight, preferably 80 to 100% by weight, based on the total amount of the aqueous medium. The content of the surfactant for adjusting the cloud point is so determined as to obtain intended could points as described above, and may fall within the range of 0.1 to 10% by weight, preferably 0.5 to 5% by weight, based on the total amount of the aqueous medium.

As the coloring material, dyes and pigments are usable. It is particularly effective for coloring materials such as a pigment to be dispersed in an aqueous medium. This is because the control of remaining bubbles in ink according to the invention, which suppresses temperature increase within a head, suppresses temperature-dependent aggregative properties of pigments dispersed in an aqueous medium to ensure good ejection properties of ink droplets. The content of the coloring material in the ink falls within the range of 0.1 to 10% by weight, preferably 1 to 5% by weight, based on the total amount of the ink.

As an ink-jet recording apparatus used in the present invention, may be used an apparatus of the so-called Bubble- Jet system that thermal energy is applied to an ink to eject the ink as ink droplets or the like from an ejecting portion. The present invention is particularly preferred for apparatus using a head of the multi-nozzle type that the sizes of a nozzle part including a flow path and an ejecting portion are made fine, and such nozzles are arranged at a high density, or a head that high-frequency drive can be conducted.

Figure 2:
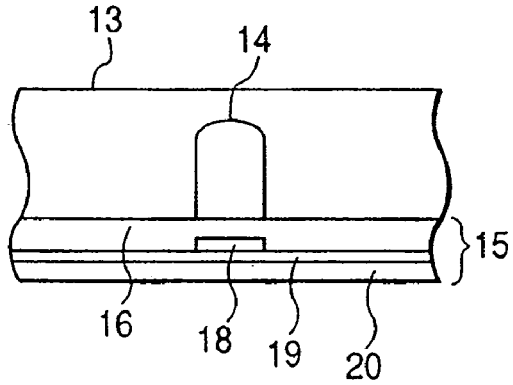
FIG. 2 is a transverse cross-sectional view of the head of the ink-jet recording apparatus.
Figure 3:
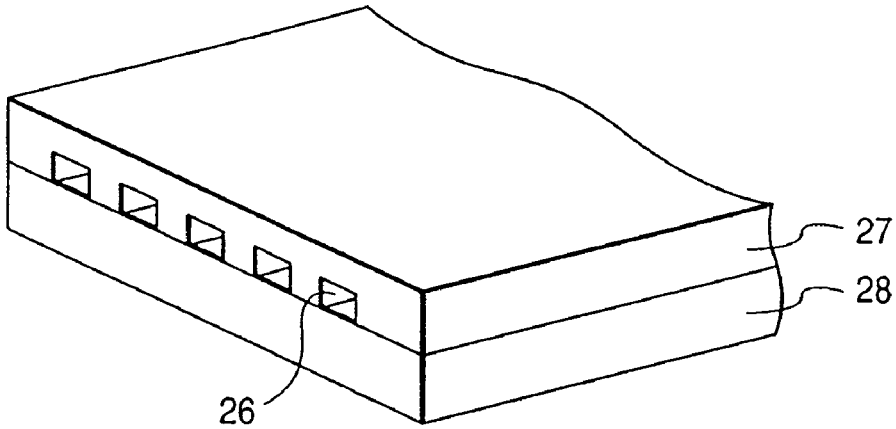
FIG. 3 is a schematic perspective view illustrating the appearance of a multi-head composed of an array of a number of heads as shown in FIG. 1.

Specific examples of such apparatus are illustrated in FIGS. 1, 2 and 3. FIG. 1 is a cross-sectional view of a head 13 taken along a flow path of an ink, and FIG. 2 is a cross-sectional-view taken along line 2—2 in FIG. 1. The head 13 is obtained by bonding a glass, ceramic, plastic plate or the like having a groove 14 through which an ink is passed, to a heating substrate 15 (the drawings show the construction of a thin film lamination type, to which, however, the invention is not limited) making up a heating element (heater). The heating substrate 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like having a good heat radiating property. An ink 21 comes up to an ejecting portion (ejecting orifice) 22 and forms a meniscus 23 due to a pressure P.

Now, upon application of electric signals to the electrodes 17-1, 17-2, the heating head 15 rapidly generates heat in a region of the heating resistor layer shown by 'n', which is not covered with the electrodes, to cause the ink 21 in contact with this region to produce film boiling, thereby generating bubbles. The meniscus 23 of the ink is projected by the action of the pressure thus produced, and the ink 21 is ejected from the ejecting portion 22 to a recording medium 25 in the form of ink droplets 24.

FIG. 3 illustrates an appearance of a multi-head composed of an array of a number of heads as shown in FIG. 1. The multi-head is formed by closely bonding a glass plate 27 having a number of grooves 26 to a heating substrate 28 having the similar construction to that described in FIG. 1.

Figure 4:
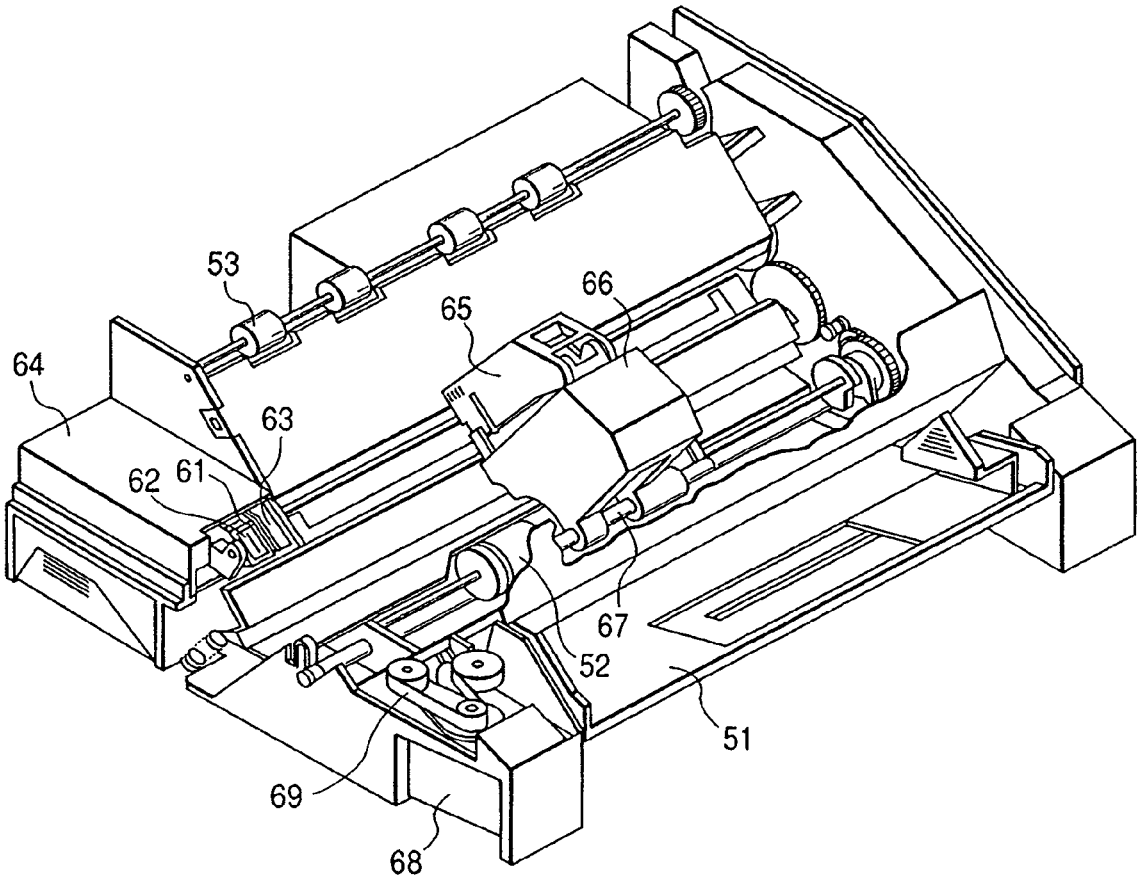
FIG. 4 is a perspective view illustrating an exemplary ink-jet recording apparatus.

FIG. 4 illustrates an exemplary ink-jet recording apparatus in which such a head has been incorporated. In FIG. 4, reference numeral 61 designates a blade serving as a wiping member, one end of which is a stationary end held by a blade-holding member to form a cantilever. The blade 61 is provided at a position adjacent to a region in which a recording head operates, and in this embodiment, is held in such a form that it protrudes into the course through which the head 65 is moved.

Reference numeral 62 indicates a cap, which is provided at a home position adjacent to the blade 61, and is so constituted that it moves in a direction perpendicular to a direction in which the head 65 is moved and comes into contact with the face of ejecting portions to cap it. Reference numeral 63 denotes an ink-absorbing member provided adjoiningly to the blade 61 and, similar to the blade 61, held in such a form that it protrudes into the course through which the head 65 is moved. The above-described blade 61, cap 62 and absorbing member 63 constitute an ejection-recovery portion 64, where the blade 61 and ink absorbing member 63 remove water, dust and/or the like from the face of the ink-ejecting portions.

Reference numeral 65 designates the head having a means (for example, the heating substrate illustrated in FIG. 1) for generating heat as ejection energy and serving to eject the ink onto a recording medium set in an opposing relation to the ejecting portion face provided with ejecting portions to conduct recording. Reference numeral 66 indicates a carriage on which the head 65 is mounted so that the head 65 can be moved. The carriage 66 is slidably interlocked with a guide rod 67 and is connected (not illustrated) at its part to a belt 69 driven by a motor 68. Thus, the carriage 66 can be moved along the guide rod 67 and hence, the head 65 can be moved from a recording region to a region adjacent thereto.

Reference numerals 51 and 52 denote a feeding part from which the recording media are separately inserted, and feed rollers driven by a motor (not illustrated), respectively. With such a construction, the recording medium is fed to the position opposite to the ejecting portion face of the head 65, and discharged from a discharge section provided with discharge rollers 53 with the progress of recording.

In the above construction, the cap 62 in the ejection-recovery portion 64 is receded from the path of motion of the head 65 when the head 65 is returned to its home position after completion of recording, and the blade 61 remains protruded into the path of motion. As a result, the ejecting portion face of the head 65 is wiped. When the cap 62 comes into contact with the ejecting portion face of the head 65 to cap it, the cap 62 is moved so as to protrude into the path of motion of the head 65.

When the head 65 is moved from its home position to the position at which recording is started, the cap 62 and the blade 61 are at the same positions as the positions for the wiping as described above. As a result, the ejecting portion face of the head 65 is also wiped at the time of this movement.

The above movement of the head 65 to its home position is made not only when the recording is completed or the head 65 is recovered for ejection, but also when the head 65 is moved between recording regions for the purpose of recording, during which it is moved to the home position adjacent to each recording region at given intervals, where the ejecting portion face is wiped in accordance with this movement.

Figure 5:
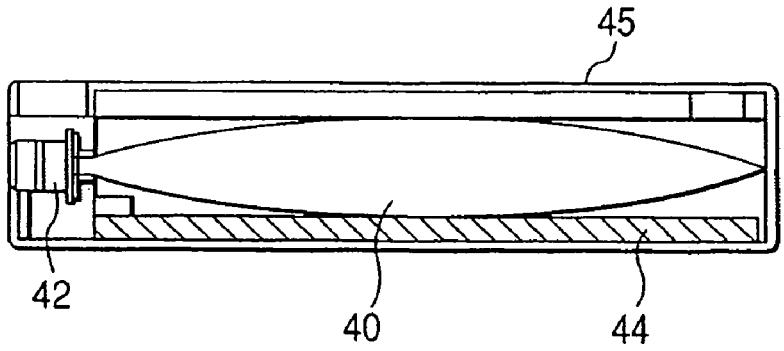
FIG. 5 is a longitudinal cross-sectional view of an ink cartridge.

FIG. 5 illustrates an exemplary ink cartridge 45 in which an ink to be fed to a head through a member for feeding the ink, for example, a tube is contained. Here, reference numeral 40 designates an ink container portion containing the ink to be fed, as exemplified by a bag for ink. One end thereof is provided with a stopper 42 made of rubber. A needle (not illustrated) may be inserted into this stopper 42 so that the ink in the bag 40 for ink can be fed to the head. Reference numeral 44 indicates an ink absorbing member for receiving a waste ink. In the present invention, it is preferred that the ink container portion 40 be formed of a polyolefin, in particular, polyethylene, at its surface with which the ink comes into contact. The ink-jet recording apparatus used in the present invention are not limited to the apparatus as described above in which the head and the ink cartridge are separately provided. Therefore, a device in which these members are integrally formed as shown in FIG. 6 can also be preferably used.

Figure 6:
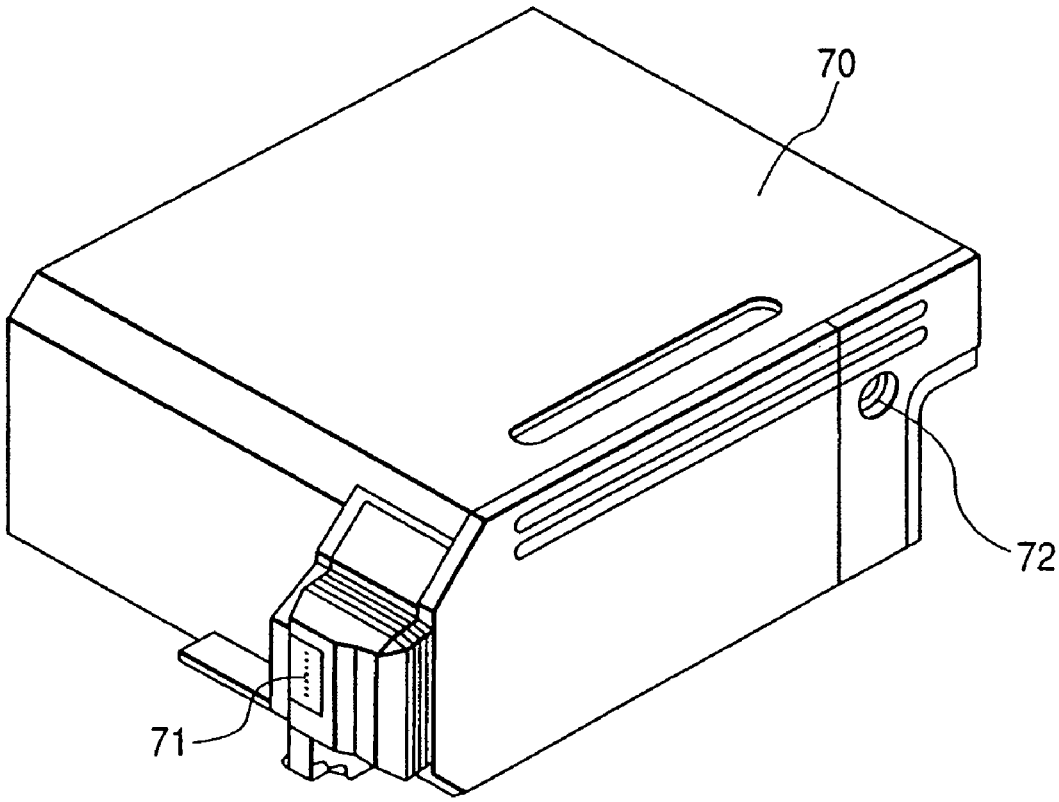
FIG. 6 is a perspective view of a recording unit.

In FIG. 6, reference numeral 70 designates a recording unit, in the interior of which an ink container portion containing an ink, for example, an ink absorbing member, is contained. The recording unit 70 is so constructed that the ink in such an ink absorbing member is ejected in the form of ink droplets through a head 71 having a plurality of orifices. In the present invention, polyurethane, cellulose or polyvinyl acetal is preferably used as a material for the ink absorbing member. Reference numeral 72 indicates an air passage for communicating the interior of the recording unit 70 with the atmosphere. This recording unit 70 is used in place of the recording head 65 shown in FIG. 4, and is detachably installed on the carriage 66.

The present invention will hereinafter be described more specifically by the following Examples and Comparative Examples.

(Preparation of Ink)

Inks used in the following Examples and Comparative Examples, which will be described subsequently, are prepared by mixing respective components, thoroughly stirring the resulting mixture into a solution or dispersion and then filtering the resultant solution or dispersion under pressure through a Fluoropore Filter (trade name; product of Sumitomo Electric Industries, Ltd.) having a pore size of 0.4 μm.

In the present invention, an ink temperature within a nozzle, which is described in evaluation items, is a value measured by incorporating a temperature sensor function into a heater that causes an ink-bubbling action for the ink.

(Evaluation 1 of Ejection Properties)

A commercially available ink-jet printer, BJC-4400 (trade name, manufactured by Canon Inc.) was used to print English characters and numerals respectively using inks obtained in the following Examples and Comparative Examples under an environment of 25° C. ($T_0$). Acetylene glycol type ethylene oxide adducts were used as an additive for adjusting the cloud point for the inks of the Examples and Comparative Examples. The ink temperature within a nozzle was a little over 60° C. ($T_1$), and the temperature within the nozzle before the printing was 25° C. ($T_0$). In a measurement of a cloud is point of a liquid obtained by removing coloring material from each of the inks prepared in the following Examples and Comparative Examples, the liquid obtained by removing the coloring material from the ink was put into a 100-cc beaker, and the liquid in the beaker was heated in a water bath to raise its temperature, thereby regarding a temperature at the time the liquid containing no coloring material began to be emulsified or become turbid as the cloud point.

INK OF EXAMPLE 1

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 30° C. (T), thereby preparing an ink according to EXAMPLE 1.

INK OF EXAMPLE 2

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 60° C. (T), thereby preparing an ink according to EXAMPLE 2.

INK OF EXAMPLE 3

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 50° C. (T), thereby preparing an ink according to EXAMPLE 3.

INK OF COMPARATIVE EXAMPLE 1

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 20 to 25° C. (T), thereby preparing an ink according to COMPARATIVE EXAMPLE 1.

INK OF COMPARATIVE EXAMPLE 2

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 65° C. (T), thereby preparing an ink according to COMPARATIVE EXAMPLE 2.

(Comparison of Printing Results)

Neither printing disorder nor bleeding was observed in the inks of EXAMPLE 2 (T=60° C.) and EXAMPLE 3 (T=50° C.). Printing disorder and bleeding were somewhat observed in the ink of EXAMPLE 1 (T=30° C.), but no dot-free blank area was observed. Printing disorder or dot-free blank areas were observed in the inks of COMPARATIVE EXAMPLE 1 (T=20 to 25° C.) and COMPARATIVE EXAMPLE 2 (T=65° C.). An ink obtained by removing the coloring material from the ink of EXAMPLE 1 to such a level that the cloud point can be identified using a centrifugal separator was used to make the same evaluation. As a result, as with EXAMPLE 1, the cloud point was not changed, and neither printing disorder nor bleeding was observed.

(Evaluation 2 of Ejection Properties)

A4-sized solid printed images of 100% duty were continuously printed with inks obtained in the following Examples and Comparative Examples under an environment of 35° C. ($T_0$) by means of a commercially available ink-jet printer, BJC-5500 (trade name, manufacture by Canon Inc.) to evaluate the inks in accordance with the following standard. At this time, the ink temperature within a nozzle was about 60° C. ($T_1$), and the temperature within the nozzle before the printing was 35° C. ($T_0$). In a measurement of a cloud point of a liquid obtained by removing coloring material from each of the inks prepared in the following Examples and Comparative Examples, the liquid containing no coloring material was put into a 100-cc beaker, and the liquid in the beaker was heated in a water bath to raise its temperature, thereby regarding a temperature at the time the liquid containing no coloring material began to be emulsified or become turbid as the cloud point.

INK OF EXAMPLE 4

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 40° C. (T), thereby preparing an ink according to EXAMPLE 4.

INK OF EXAMPLE 5

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 60° C. (T), thereby preparing an ink according to EXAMPLE 5.

INK OF EXAMPLE 6

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 50° C. (T), thereby preparing an ink according to EXAMPLE 6.

INK OF COMPARATIVE EXAMPLE 3

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 30° C. (T), thereby preparing an ink according to COMPARATIVE EXAMPLE 3.

INK OF COMPARATIVE EXAMPLE 4

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 70° C. (T), thereby preparing an ink according to COMPARATIVE EXAMPLE 4.

(Comparison of Printing Results)

A4-sized solid printed images of the 100% duty were able to be continuously printed on at least 40 sheets of recording media with the inks of EXAMPLE 5 (T=60° C.) and EXAMPLE 6 (T=50° C.) When ejecting portions were observed, no bubble was present. A4-sized solid printed images of the 100% duty were able to be continuously printed on 40 sheets of recording media with the ink of EXAMPLE 4 (T=40° C.), but a blank area was observed in a part of the prints, and bubbles were present when ejecting portions were observed. A4-sized solid printed images of the 100% duty were unable to be continuously printed on 40 sheets of recording media with the inks of COMPARATIVE EXAMPLE 3 (T=30° C.) and COMPARATIVE EXAMPLE 4 (T=70° C.). Further, a great number of bubbles were present in the ejecting portions when the inks of COMPARATIVE EXAMPLE 3 and COMPARATIVE EXAMPLE 4 were used.

(Evaluation 3 of Ejection Properties)

Postal-sized solid printed images of 100% duty were continuously printed with inks obtained in the following Examples and Comparative Examples under an environment of 15° C. ($T_0$) by means of a commercially available ink-jet printer, P-400C (trade name, manufacture by Canon Inc.) to evaluate the inks in accordance with the following standard. At this time, the ink temperature within a nozzle was about 360° C. ($T_1$), and the temperature within the nozzle before the printing was 15° C. ($T_0$). In a measurement of a cloud point of a liquid obtained by removing coloring material from each of the inks prepared in the following Examples and Comparative Examples, the liquid containing no coloring material was put into a 100-cc beaker, and the liquid in the beaker was heated in a water bath to raise its temperature, thereby regarding a temperature at the time the liquid containing no coloring material began to be emulsified or become turbid as the cloud point.

INK OF EXAMPLE 7

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 20° C. (T), thereby preparing an ink according to EXAMPLE 7.

INK OF EXAMPLE 8

Twenty % by mass of Cabojet 300 (trade name, product of CABOT Co., a 15% by mass aqueous dispersion) as a water-dispersing coloring-material were added to a liquid containing no coloring material, the composition of which was adjusted in such a manner that its cloud point becomes 60° C. (T), thereby preparing an ink according to EXAMPLE 8.

INK OF EXAMPLE 9

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 50° C. (T), thereby preparing an ink according to EXAMPLE 9.

INK OF COMPARATIVE EXAMPLE 5

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 15° C. (T), thereby preparing an ink according to COMPARATIVE EXAMPLE 5.

INK OF COMPARATIVE EXAMPLE 6

Twenty % by mass of Cabojet 300 (trade name, product of CABOT Co., a 15% by mass aqueous dispersion) as a water-dispersing coloring material were added to a liquid containing no coloring material, the composition of which was adjusted in such a manner that its cloud point becomes 70° C. (T), thereby preparing an ink according to COMPARATIVE EXAMPLE 9.

(Comparison of Printing Results)

Postal-sized solid printed images of the 100% duty were able to be continuously printed on at least 40 sheets of recording media with the inks of EXAMPLE 8 (T=60° C.) and EXAMPLE 9 (T=50° C.). When ejecting portions were observed, no bubble was present. Postal-sized solid printed images of the 100% duty were able to be continuously printed on not less than 50 sheets but less than 100 sheets of recording media with the ink of EXAMPLE 7 (T=20° C.). However, when ejecting portions were observed when printing with the ink was unable to be conducted due to entire ejection failure of the nozzle, a great number of bubbles were present. Postal-sized solid printed images of the 100% duty were able to be continuously printed on only less than 50 sheets of recording media with the inks of COMPARATIVE EXAMPLE 5 (T=15° C.) and COMPARATIVE EXAMPLE 6 (T=70° C.). When ejecting portions were observed at this time, a great number of bubbles were present.

According to the present invention, as described above, the cloud point of a liquid obtained by removing coloring material from an ink is preset to a temperature higher than the lower limit of the temperature-changing range of the ink attending on the bubble process of generation, growth and disappearance of bubbles within a flow path, on which heat from a heater in a head acts, a part of the ink, with which the bubbles come into contact, is locally heated to a temperature higher than the cloud point, the part of the ink, with which the bubbles come into contact, undergoes property change (typically, from a hydrophilic state as a whole to a mixed state of a hydrophilic portion and a hydrophobic portion), so that the process of generation, growth and disappearance of the bubbles can be caused to progress in a good state, and improvements of ink ejection properties, such as improvement of responsiveness to ejection signals, retention of ink droplet form, prevention of defective ejection of ink droplets and improvement of ink droplet impact accuracy, can be achieved.

According to the present invention, the bubble process including the course of generation, growth and disappearance of bubbles, which is started by applying ejection signals to a heater, can be caused to functionally progress, and property change at a bubble-adjoining part forming an interface between the bubbles and the ink can prevent unnecessary temperature rise of the ink within the whole flow path by a function that is considered to lower temperature-transmitting ability at the bubble-adjoining part, and natural generation of bubbles that may form the cause of defective ejection or the like in some cases can also be inhibited.

Even when bubbles are mixed into a flow path from a liquid chamber, the influence of the mixed bubbles can be reduced or eliminated by the functional progress of the bubble process by presetting the cloud point of the liquid obtained by removing the coloring material from the ink to a temperature higher than the lower limit of the temperature-changing range in ejection of the ink. Incidentally, in the case of the Bubble-Jet system that thermal energy is applied to an ink to generate bubbles, thereby ejecting the ink from an ejecting portion, the disappearance speed of the bubbles until the bubbles become smaller, and finally disappear may be often designed in such a manner that it depends on natural diffusion of heat into the ink within the flow path or a material forming the flow path. In order to accelerate this disappearance speed, it is also proposed to quench the interior of the flow path. However, a device or a system for doing so, and electric power for driving it are additionally required, and cost for the quenching is also expensive, and so it is hard to be applied to heads and recording apparatus the prices and running costs of which have to be reduced. On the other hand, in the system according to the present invention, improvement of the disappearance speed and stable progress of the disappearance process can be achieved by the simple constitution that the cloud point of the liquid obtained by removing the coloring material from the ink is controlled, and so the above-described problem caused by using the cooling device is not offered.

This application claims priority from Japanese Patent Application No. 2003-434526 filed Dec. 26, 2003, which is hereby incorporated by reference herein.

What is claimed is:

1. An ink-jet recording method comprising a step of applying thermal energy to an ink to generate bubbles thereby ejecting the ink from an ejecting portion to record, wherein the relationship among a cloud point (T) of a liquid obtained by removing coloring material from the ink, a temperature $T_0$ of the ink before formation of the bubbles in a portion in which the bubbles are generated and a temperature $T_1$ of a part of the ink, which includes a portion in contact with the bubbles and surrounds the bubbles, satisfies $T_0<T<T_1$.

2. The ink-jet recording method according to claim 1, wherein the ink comprises water, an aqueous medium, a coloring material and a surfactant.

3. The ink-jet recording method according to claim 2, wherein the coloring material is a water-dispersing coloring material.

4. The ink-jet recording method according to claim 1 or 2, wherein the temperature $T_0$ is at most 40° C., and the temperature $T_1$ is at least 60° C.

5. An ink-jet recording method comprising a step of causing an ink to produce film boiling to eject ink droplets from an ejecting portion, thereby recording, wherein a cloud point (T) of a liquid obtained by removing coloring material from the ink falls within a range of from 50° C. to 60° C.

6. An ink-jet ink, to which thermal energy for causing the ink to produce film boiling is applied, and which comprises water, an aqueous medium, a coloring material and a surfactant, wherein a cloud point (T) of a liquid obtained by removing the coloring material from the ink falls within a range of from 50° C. to 60° C.

7. An ink tank for containing an ink-jet ink, to which thermal energy for causing the ink to produce film boiling is applied, and which comprises water, an aqueous medium, a coloring material and a surfactant, wherein a cloud point (T) of a liquid obtained by removing the coloring material from the ink falls within a range of from 50° C. to 60° C.

8. A cartridge comprising a container portion for containing an ink comprising water, an aqueous medium, a coloring material and a surfactant and an electrothermal conversion element for applying thermal energy to cause the ink to produce film boiling, wherein a cloud point (T) of a liquid obtained by removing the coloring material from the ink falls within a range of from 50° C. to 60° C.

* * * * *

UNITED STATES PATENT AND TRADEMARK OFFICE

CERTIFICATE OF CORRECTION

PATENT NO. : 7,195,340 B2
APPLICATION NO. : 11/019533
DATED : March 27, 2007
INVENTOR(S) : Akira Nagashima et al.

It is certified that error appears in the above-identified patent and that said Letters Patent is hereby corrected as shown below:

ON THE TITLE PAGE

Item (56), FOREIGN PATENT DOCUMENTS,

"JP 8034124" should read --JP 8-034124--.

"JP 2001354880" should read --JP 2001-354880--.

"JP 2002080768" should read --JP 2002-080768--.

COLUMN 3

Line 63, "referred" should read --referred to--.

COLUMN 5

Line 54, "hither" should read --higher--.

Line 62, "invention," should read --invention, there--.

COLUMN 6

Line 16, "value," should read --value, there--.

Line 20, "ink," should read --ink, there--.

Line 32, "examples" should read --example--.

Line 36, "accelerators" should read --accelerators,--.

Line 51, "could" should read --cloud--.

Line 67, "invention," should read --invention, there--.

UNITED STATES PATENT AND TRADEMARK OFFICE

CERTIFICATE OF CORRECTION

PATENT NO. : 7,195,340 B2
APPLICATION NO. : 11/019533
DATED : March 27, 2007
INVENTOR(S) : Akira Nagashima et al.

It is certified that error appears in the above-identified patent and that said Letters Patent is hereby corrected as shown below:

COLUMN 7

Line 11, “cross-sectional-view” should read --cross-sectional view--.

COLUMN 9

Line 28, “cloud is point” should read --cloud point--.

COLUMN 10

Line 40, “manufacture” should read --manufactured--.

COLUMN 11

Line 60, “manufacture” should read --manufactured--.

COLUMN 13

Line 45, “ink. Incidentally” should read --ink. ¶ Incidentally--.

Signed and Sealed this

Twentieth Day of May, 2008

JON W. DUDAS
*Director of the United States Patent and Trademark Office*